US007654921B2

(12) United States Patent
Brunst

(10) Patent No.: US 7,654,921 B2
(45) Date of Patent: Feb. 2, 2010

(54) BASEBALL BATTING TRAINING AID

(76) Inventor: Steven J. Brunst, 2749 Mesa Dr., Oceanside, CA (US) 92054

( * ) Notice: Subject to any disclaimer, the term of this patent is extended or adjusted under 35 U.S.C. 154(b) by 130 days.

(21) Appl. No.: 12/050,403

(22) Filed: Mar. 18, 2008

(65) Prior Publication Data

US 2008/0167144 A1 Jul. 10, 2008

Related U.S. Application Data

(63) Continuation-in-part of application No. 11/435,674, filed on May 16, 2006, now abandoned, which is a continuation-in-part of application No. 10/371,542, filed on Feb. 19, 2003, now abandoned.

(51) Int. Cl.
*A63B 69/00* (2006.01)

(52) U.S. Cl. ..... 473/452; 473/422; 473/450; 473/458

(58) Field of Classification Search ..... 473/458, 473/450, 464, 422, 438, 215–217; 128/875–877, 128/846; 482/121, 122, 124, 125
See application file for complete search history.

(56) References Cited

U.S. PATENT DOCUMENTS 1,618,273 A 2/1927 Davidson
4,685,671 A * 8/1987 Hagerman et al. ..... 482/124
4,955,608 A * 9/1990 Dougherty et al. ..... 473/450
5,062,642 A * 11/1991 Berry et al. ..... 473/277
5,203,754 A * 4/1993 Maclean ..... 482/124
5,256,119 A * 10/1993 Tudor ..... 482/74
5,303,927 A 4/1994 Perry et al.
5,647,827 A * 7/1997 Gutkowski et al. ..... 482/124
5,993,362 A * 11/1999 Ghobadi ..... 482/124
6,179,760 B1 * 1/2001 Rumbaugh ..... 482/121
6,428,495 B1 * 8/2002 Lynott ..... 602/23
6,551,221 B1 * 4/2003 Marco ..... 482/74
6,875,135 B2 4/2005 Tracy, Sr.

* cited by examiner

*Primary Examiner*—Mitra Aryanpour
(74) *Attorney, Agent, or Firm*—George S. Levy

(57) ABSTRACT

A batting training aid and method of use to improve baseball players' batting stance and swinging motion. The stance is characterized by a high center of gravity, erect posture with one leg forward, and the other backward. The proper swinging motion is around a vertical axis. The batting training aid comprises: a waist belt; an anklet; a stirrup attached to the anklet; a strap connected at one end to the belt and at the other to the anklet. The length of the strap is adjusted to a predetermined length set to the maximum separation between the back ankle and the waist and configured to force players into the proper batting stance and proper swinging motion. The method of use comprises adjusting the length of strap; adopting batting stance; batting at ball; sensing a tug between the waist and the ankle; and correcting the batting stance to eliminate the tug.

2 Claims, 4 Drawing Sheets

BASEBALL BATTING TRAINING AID

CROSS-REFERENCE TO RELATED APPLICATIONS

This application is a continuation-in-part of U.S. patent application Ser. No. 11/435674 filed on May 16, 2006 now abandoned entitled Baseball Hitting Aid, which is hereby incorporated by reference and which also is a continuation-in-part of U.S. patent application Ser. No. 10/371,542, filed on Feb. 19, 2003 now abandoned entitled "Power Hitter's Helper," which is also incorporated by reference.

FIELD OF THE INVENTION

The present invention relates generally to a mechanical aid for improving a sporting technique. More specifically, the present invention relates to a device that a baseball batter wears to train in improving his baseball batting technique.

BACKGROUND

Learning to hit a baseball can be difficult, especially for younger batters. Improper stance, a poor swing, improper weight distribution, and lack of good hand-eye coordination all contribute to the difficulty in learning how to hit a baseball skillfully.

A recurrent problem affecting a beginner batter in baseball is that he has the tendency to "lunge" at the ball using only his strength in his arms to swing the bat. When a batter mistakenly transfers his weight forward he loses power in the swing. Furthermore, his head moves up as the ball is going down, making the ball harder to see and to hit. A better technique is for the batter to swivel or rotate his hips around a vertical axis in such a fashion as to use his whole body to impart energy to the bat. The difference between "lunging" and "rotating" is that in lunging, the batter's rear leg is straightened thus pushing the batter's upper body forward past the vertical axis. However, in rotating, the batter remains at the axis of rotation: his rear leg bends at the knee and stays below him, aligned with the axis of rotation as he rotates his hips thereby providing the batter with the maximum batting power. It is therefore important for a beginner to be provided with immediate feedback regarding his stance and more specifically regarding the position of his rear leg in relation to his axis of rotation as he hits the ball.

Therefore, a mechanical device is desirable that would provide an easy, quick and safe way to train the hitter in the proper stance and swinging technique to maximize the energy imparted to the ball while lessening the chances for injury due to improper swinging. Conjointly, a method using the aforesaid mechanical device needs to be developed that trains batters in improving their batting technique.

U.S. Pat. No. 1,618,273 by Davidson describes a device comprising multiple belts to which two elastic straps are attached at one of their ends. The straps, at their other ends, are attached to the hands and feet of the user. This device is used for exercise but is too complicated and is not specifically designed to train baseball batters. In addition, the device is designed to exercise a force on the user when used properly. In contrast, in the Present Invention, no force or tug is applied to the batter when he has achieved the correct swinging technique.

U.S. Pat. No. 5,303,927 by Perry is a device designed to create a rotational torque around the hip of a golfer. This device cannot be used to train baseball batters because it does not restrict the back leg of the batter. In addition its dimensions which require that it be wound around the golfer's body make it inadequate for training in baseball. Perry's invention provides torque even if the golfer's stance is adequate. In contrast, in the Present Invention, no force is applied to, or felt by, the batter if his stance and swing are correct.

U.S. Pat. No. 6,875,135 by Tracy, Sr. is designed to help athletes maintain a center of gravity close to the ground as is appropriate for football training. However, it cannot be used to train baseball batters who need to keep their center of gravity elevated. Two straps attached to the belt restrict the movement of both legs and their dimensions are too short: they are designed to keep the wearer down which is appropriate for training in football but not in offensive baseball. The Present Invention restricts the movement of only the rear leg without restricting the front leg or forcing the batter to maintaining a low center of gravity.

None of the prior art offers the functionality, flexibility of use, simplicity and economy of this invention. Further features, aspects, and advantages of the present invention over the prior art will be more fully understood when considered with respect to the following detailed description claims and accompanying drawings.

SUMMARY OF THE INVENTION

Figure 1:
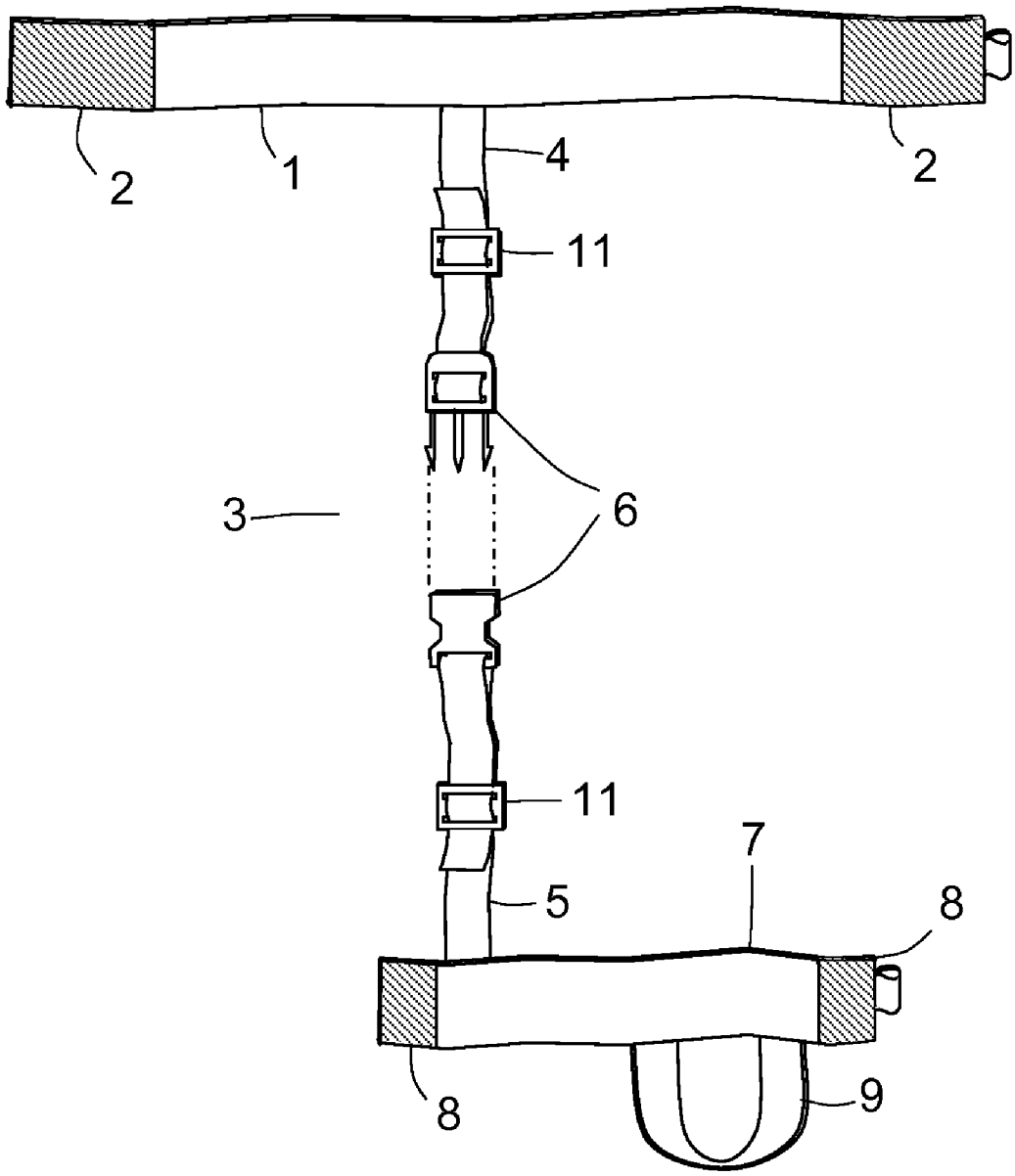
FIG. 1 shows the device. It comprises a belt, a strap attached to the belt, an anklet attached to the strap and a stirrup attached to the anklet.

This invention is a device and method for training a baseball player in his batting technique. The device and method help him achieve a proper baseball batting stance as he faces an incoming ball. This stance is characterized by a high center of gravity typical of someone batting at a baseball. It is an essentially erect posture characterized in part by one leg of the player positioned toward the incoming ball, and the other leg also called the back leg, away from the incoming ball. In addition, this batting training aid is designed for training baseball players in achieving a proper swinging motion characterized by:

a) pivot motion of back foot;

b) locked state of the front leg at the knee;

c) rotation of the hips and upper body around a vertical axis, said axis going essentially through said player's navel;

d) swing of the bat with the arms;

The batting training aid comprises:

a) a waist belt configured to encircle the player's waist and equipped with a fastener to ensure that the belt remains snugly around the player's waist;

b) an ankle strap also called in this document, an anklet, configured to be wrapped around the back ankle and equipped with a fastener to ensure that it remains snuggly wrapped around the back ankle;

c) a stirrup attached to the back anklet. This stirrup configured to accept the back foot of the player.

d) a strap connected at its top end to the belt and at its lower end to the anklet. The length of the strap, adjustable by means of at least one adjusting buckle mounted on the strap, is set to a predetermined length, This length is set to the maximum separation permitted between said back ankle and said waist; it is configured to allow the player to adopt the proper batting stance; It is furthermore configured to allow the player to achieve the proper swinging motion essentially without feeling a tug between said belt and said anklet; and in addition, it is configured to allow the player to feel a tug between the belt and the anklet if he deviates from the proper swinging motion which comprises pivoting of the back foot; locking the front leg at the knee; rotating of the hips and upper body around a vertical axis, said axis going essentially through said player's navel; swinging of the bat with the arms.

e) putting on the device in claim 1, which comprises:

i. wrapping and fastening said belt around said player's waist;

ii. determining which leg said player places forward and which leg he places backward when he adopts a batting stance;

iii. inserting player's foot on said back leg into said stirrup; and iv. wrapping said anklet around player's ankle of said back leg;

The method of utilizing this batting training aid comprises:

a) adjusting the length of the strap to a predetermined length defined as stated above;

b) adopting a batting stance;

c) batting at the ball;

d) sensing if the strap exerts a tug between the waist and the ankle during batting; and e) correcting the batting stance to a new stance which does not result in tugging between the waist and the back ankle.

DETAILED DESCRIPTION OF THE INVENTION

A baseball batter uses two parts of his body to hit a baseball: the upper half, i.e., hands, arms, head and torso; and the lower half, i.e., hips, legs, knees, and feet. The baseball batting aid is concerned with the lower half. It is a training tool used to help a batter control his stance and the use of his legs and waist. It can be adapted for either right or left-handed hitters, both short and tall.

Figure 2:
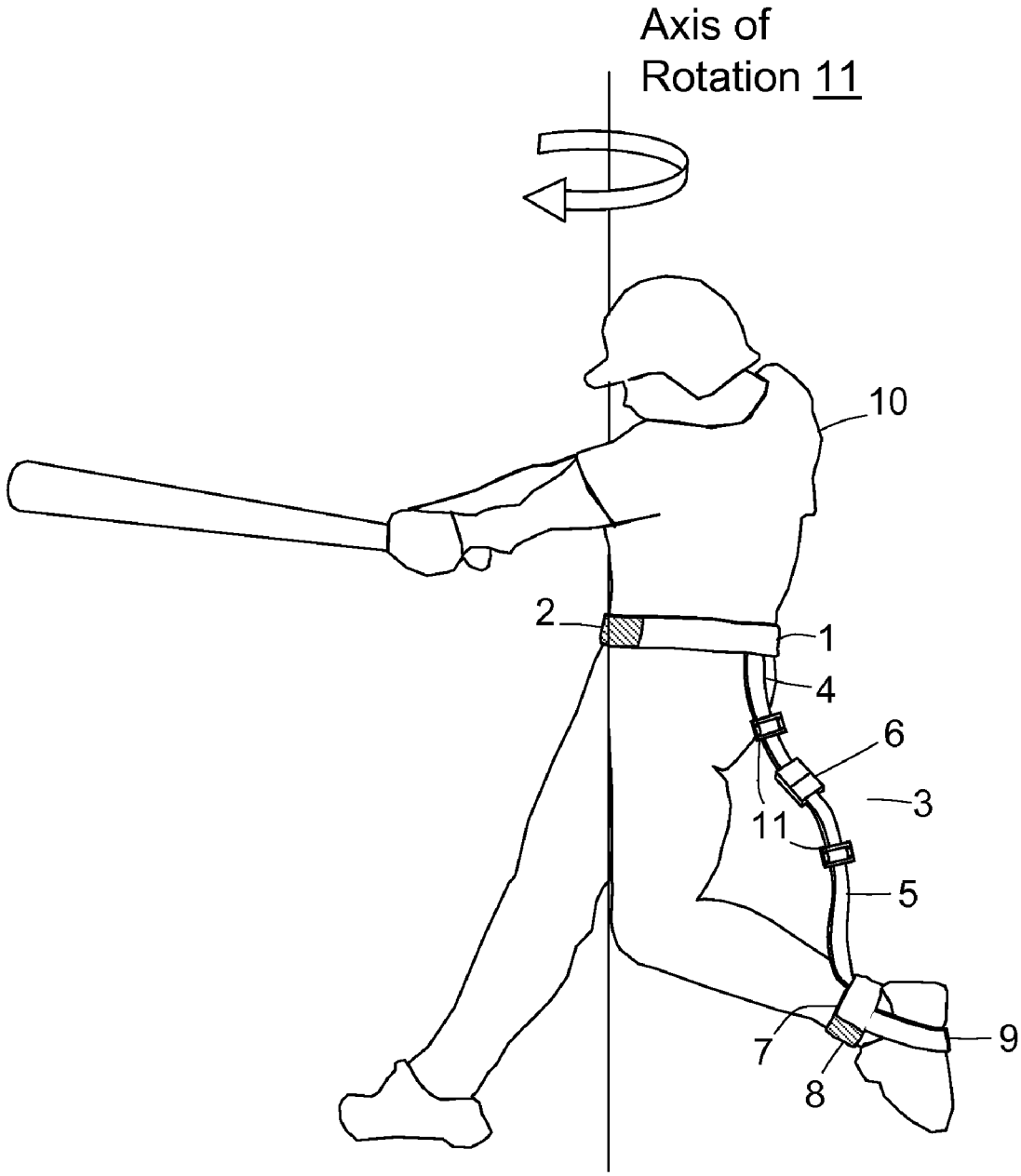
FIG. 2 illustrates how a baseball batter in training can use the batting aid. The drawing shows the batter in the correct stance: the strap between the belt and the stirrup is loose.

FIG. 1 illustrates one embodiment of the invention. It comprises a belt 1 equipped with a VELCRO™ fastener 2. Clearly, those knowledgeable in the art will appreciate that other kinds of fasteners could be appropriate to close the belt 1. FIG. 2 illustrates a batter 10 wearing the device for training purposes. The belt 1 is designed to be wrapped around the waist of the batter 10.

A strap 3 is, at its upper end, attached to the belt 1. Preferably, this strap is made of elastic material. It can be made of a single piece, or as shown in FIG. 1, or two pieces: an upper piece 4 connected to the belt, and a lower piece 5 joined to the upper piece by a fastening buckle 6. In addition, the strap has length adjustment buckles 11. If the strap is made of one piece, clearly it does not need a fastening buckle but may use an adjustment buckle 11.

At its lower end, the strap 3 is attached to an ankle strap 7 which shall be referred to in this document as an anklet. This anklet 7 is designed to be wrapped securely around the ankle of the batter's rear leg. For example, if the batter 10 is right-handed, his rear leg is on the right. If he is left handed, the rear leg is on the left. The anklet 7 is equipped with a VELCRO™ fastener 8.

Attached to the anklet 7 is a stirrup 9 which forms with part of the anklet, a loop through which the foot of the batter 10 can be inserted. The stirrup 8 can also be made of elastic material.

It can be appreciated that the straps and the stirrups can also be made of non-elastic material.

Method of Use: The device described in this document is used to train a batter 10 to achieve a correct stance in baseball. To use the device the batter 10 puts the device on. First, he puts on the belt 1 and secures it around his waist by means of the fastener 2. The belt 1 is aligned such that the strap 3 hangs downward approximately over the back pocket of the rear leg of the batter 10.

The batter then inserts his foot in the stirrup 9 and wraps the anklet 7 around his ankle. If the strap 3 consists of two parts 4 and 5, he can then join the upper strap 4 to the lower strap 5 by means of the fastening buckle 6. The batter or the coach can then adjust the length of the straps 3 by sliding the adjustment buckles 11. The batter is now ready for training.

Figure 3:
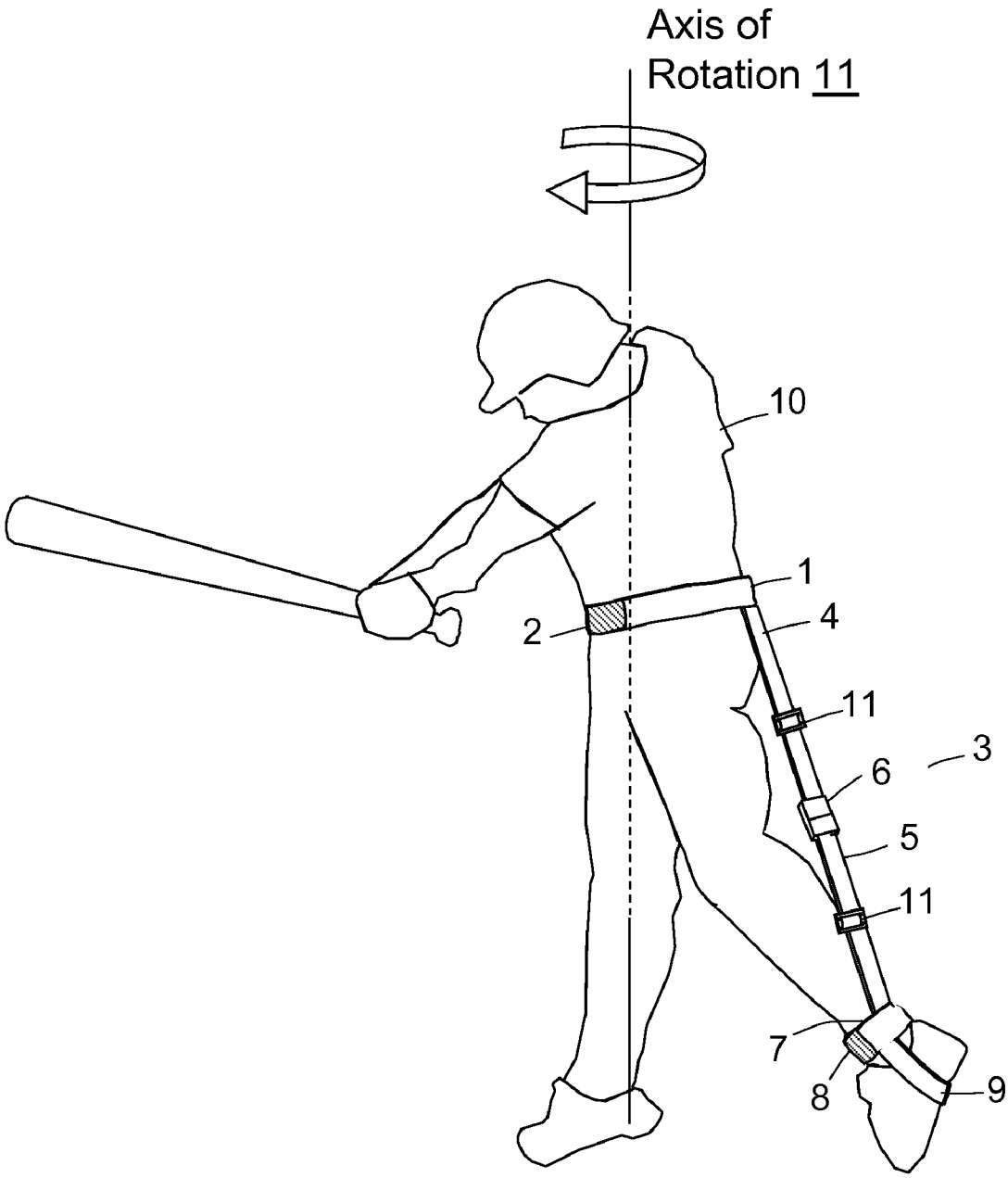
FIG. 3 illustrates how a baseball batter in training can use the batting aid. The drawing shows the batter in a lunging stance, which is incorrect: the strap between the belt and the stirrup is taut providing feedback to the batter so that he can learn proper technique and correct his error.

FIG. 2 and FIG. 3 respectively illustrate the correct and incorrect stance in hitting a ball. As the figures show, the correct stance requires that the batter rotate his hips around an axis of rotation 12, the axis being vertical and aligned with the user's belt buckle or if he doesn't wear a belt, with his navel. The lower part of the leg is almost horizontal essentially forming an "L." As can be seen in the drawing, the strap 3 between the belt 1 and the anklet 7 is loose, and therefore the batter experiences no tug between his waist and his ankle. This stance allows the batter 10 to apply maximum energy to the ball by keeping a constant vertical axis during the swing of the bat.

In contrast the stance taken by the batter 10 in FIG. 3 is incorrect. He is lunging at the ball: his straightened back leg forces his hips and upper body to move forward, ahead of the vertical axis. The axis of rotation of the bat is aligned with his front leg and consequently he loses power in his hit. The strap 3 is now taut and he can feel its tug, thereby providing him with feedback about his incorrect stance.

Figure 4:
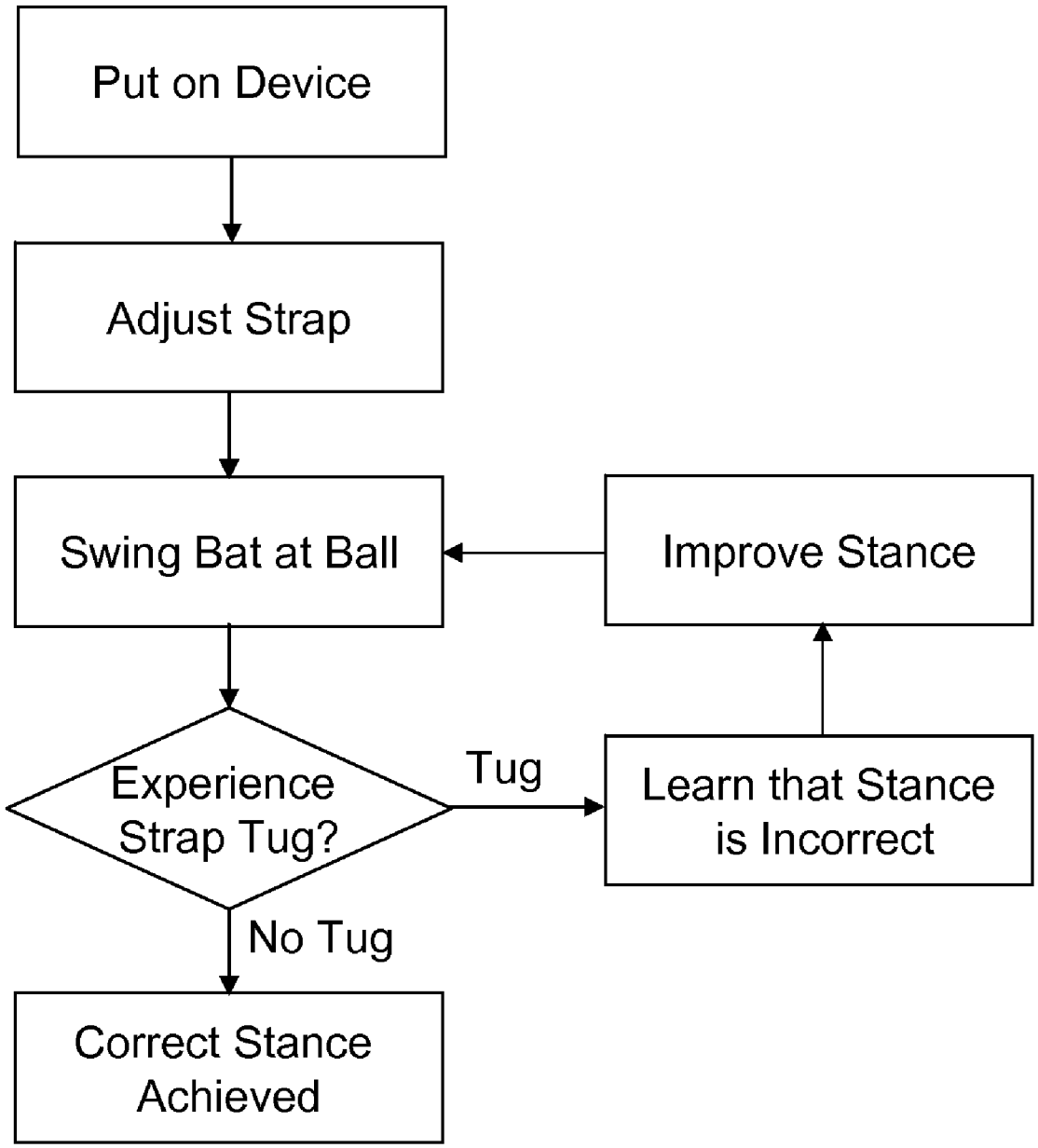
FIG. 4 provides a block diagram of the method of using the device for training purposes.

FIG. 4 is a simple block diagram illustrating the learning process of the batter. To learn he should execute the following steps:

1) Put on the device.

2) Join the upper part 4 of the strap to the lower part 5 of the strap by means of the fastening buckle 6.

3) Adjust the length of the strap 3 by means of the adjustment buckles 11 to generate a slight tension between the belt and the anklet when the batter is in an erect batting position. The length of the strap 3 could be adjusted according to a length determined to ensure that he does not "lunge" during batting and that he maintains a proper stance. The slight tension can be achieved by having the batter, with his feet a little more than shoulders width apart (approximately between 1¼ and 1½ shoulder width apart), bend his knees inward enough to hold a baseball between them. Once in this position, his legs are slightly bent into an appropriate position to ensure that the player does not lunge during batting and that he maintains a proper stance.

4) Sense if he experiences a tug from the strap 3.

5) If he does not experience any tug, his stance is correct. Otherwise he should revise his stance and try again.

The batting aid somewhat prevents the rear leg from extending fully as the connecting strap 3 is shorter than the vertical distance between the batter's waist and his or her ankle. Because the strap 3 is elastic, the batter 10 is able to extend the leg fully, but he or she feels a strong tug when doing so. Thus, the batter 10 is constantly reminded not to fully extend the leg, and to keep a bend in the rear leg. After a few trials, the batter 10 learns to keep the rear leg bent; the strap 3 slackens during use and does not tug on the batter's waist or ankle. The batting aid thus assists in preventing the rear leg from extending fully and teaches the batter 10 not to lunge forward.

The batter 10 stands with his feet separated a little more than shoulders width, facing sideways, or 90 degrees to the pitcher. As the pitcher starts his windup, the batter 10 bends his knees slightly and lifts the heel of his back foot, placing his weight on the inside toe of his back foot. By reducing the area of the rear foot contact with the ground and by placing his weight on the toe, the batter can more easily pivot his back foot. This action is commonly called "squash the bug" among baseball fans.

As the pitcher throws the ball, the batter takes a small step with his front foot and locks his front leg, rotating his back foot, bent knee, and hips. If the batter 10 now attempts when he swings the bat to transfer his weight forward by extending his rear leg, i.e., lunging (a common batting mistake), the strap 3 exerts a tug on both the belt 1 and the anklet 7. The batter 10 then feels the tug and is discouraged from lunging. In the embodiment where the extensions are of an elastic material, it is possible for the batter 10 to fully extend the leg, but it is slightly difficult. The batter's rear leg is now in what is called a power "L" position. (The power "L" position refers to the fact that the batter's rear leg appears to be in the shape of an "L" when viewed from the side as the batter swings.)

The batting aid will help batters 10 swing at a baseball using their hips and legs while keeping their weight over the inside of the back knee. As he swings, the batter remains at the axis of rotation. When a batter proceeds in the order mentioned, the power is generated from the ground up and along the vertical axis.

I claim:

1. A method for training a baseball player proper baseball batting stance and proper swinging motion using a batting training aid comprising the steps of:

providing a batting training aid, said batting training aid comprising:

a waist belt configured to encircle said player's waist and equipped with a fastener to ensure that said waist belt remains snugly around said player's waist;

an anklet configured to be wrapped around said player's trailing ankle and equipped with a fastener to ensure said anklet remains snuggly wrapped around said trailing ankle;

a stirrup attached to said anklet, said stirrup configured to accept said player's trailing foot;

a strap, said strap connected at an upper portion to said waist belt and at a lower portion to said anklet, a length of said strap being adjustable by means of at least one adjusting buckle mounted on said strap, said length of said strap being adjusted to a predetermined length; said predetermined length defining a maximum separation permitted between said player trailing ankle and said player waist;

said predetermined length configured to aid said player to achieve a proper batting stance;

said predetermined length furthermore configured to aid said player to achieve said proper swinging motion essentially without feeling a tug between said waist belt and said anklet;

wherein said predetermined length, is further configured to allow said player to feel a tug between said waist belt and said anklet should said player deviate from a proper swinging motion;

when said batting training aid is used to train a baseball player a proper baseball batting stance comprising the steps of:

a) placing said batting training aid on said player:

i) wrapping and fastening said waist belt around said player's waist;

ii) determining said player's leading and trailing foot; placing said player's leading foot forward of said player's body and positioning said player trailing foot rear of said player's body;

iii) inserting said player's trailing foot into said stirrup; and iv) wrapping said anklet around said player's trailing ankle;

b) adjusting a length of said strap to a predetermined length;

i) said predetermined length defining a maximum separation permitted between said player's trailing ankle and said player's waist;

ii) said predetermined length configured to aid said player to achieve a proper batting stance;

iii) said predetermined length, further configured to aid said player to achieve a proper swinging motion essentially without feeling a tug between said waist belt and said anklet; and iv) said predetermined length, further configured to allow said player to feel a tug between said waist belt and said anklet when said player deviates from a proper swinging motion;

c) said player adopting a proper batting stance;

d) said player batting at said incoming ball;

e) said player sensing when said strap exerts a tug between said player waist and said player ankle during a batting step; and f) said player correcting said improper batting stance to a proper batting stance which does not result in tugging between said player waist and said player trailing ankle;

said player stance characterized in part by a high center of gravity as found in an essentially erect posture;

when said batting training aid is used to train a player a proper swinging motion comprising the steps of:

placing said batting training aid on said player:

pivoting said player's trailing foot;

locking said player's leading knee; and rotating said player's hip and upper body around a vertical axis, said vertical axis extending essentially through said player's navel;

wherein said player swinging a bat towards said incoming ball.

2. A method as in claim 1 wherein said strap in said batting aid device also comprises two segments, an upper segment and a lower segment, said upper segment connected at said upper segment top end to said belt, and at said upper segment low end to said lower segment by means of a fastening buckle, said lower segment connected to said anklet at said lower segment low end, said method also comprising joining said upper strap to said lower strap by means of said fastening buckle.

* * * * *